United States Patent [19]

Feichtner et al.

[11] 4,221,559

[45] Sep. 9, 1980

[54] PROCESS AND APPARATUS FOR FIRING PELLETS

[75] Inventors: Hanns Feichtner, Hellmonsödt; Peter Scheikl, Ottensheim, both of Austria

[73] Assignee: Voest-Alpine Aktiengesellschaft, Linz, Austria

[21] Appl. No.: 974,096

[22] Filed: Dec. 28, 1978

[30] Foreign Application Priority Data

Mar. 24, 1978 [AT] Austria ..... 2119/78

[51] Int. Cl.[3] ..... F26B 9/12

[52] U.S. Cl. ..... 432/18; 432/78; 266/178

[58] Field of Search ..... 432/18, 78, 59, 72, 432/8, 11; 34/20; 266/178; 75/5

[56] References Cited

U.S. PATENT DOCUMENTS

| | | | |
|---|---|---|---|
| 2,750,274 | 6/1956 | Lellep | 432/11 |
| 3,005,699 | 10/1961 | Erck et al. | 266/178 |
| 3,172,754 | 3/1965 | Anthes et al. | 266/178 |
| 3,244,507 | 4/1966 | Linney | 266/178 |
| 3,787,171 | 1/1974 | Cromp | 432/72 |
| 3,871,631 | 3/1975 | Biewinga | 266/178 |
| 4,005,979 | 2/1977 | Brock | 432/8 |

*Primary Examiner*—Henry C. Yuen
*Attorney, Agent, or Firm*—Kurt Kelman

[57] ABSTRACT

A charge of pellets is moved on a traveling grate in succession through first and second drying zones, a preheating zone, first and second firing zones, and first and second cooling zones, in that order. The pellets are dried in the first and second drying zones, preheated in the preheating zone, fired in the first and second firing zones, and cooled in the first and second cooling zones. Cooling air is forced through the charge in the first and second cooling zones. A first stream of cooling air is exhausted from the first cooling zone and delivered at least in part to the first and second firing zones. A second stream of used cooling air is exhausted from the second cooling zone and delivered to one of the drying zones. A first exhaust gas stream is withdrawn from the second firing zone and cooled in a waste heat boiler. A second exhaust gas stream is withdrawn from the first firing zone and mixed with the first exhaust gas stream which has been cooled in a waste heat boiler, whereby a mixed exhaust gas stream is formed. This mixed exhaust gas stream is supplied at least in part to the other drying zone. A branch stream is withdrawn from the first stream of used cooling air or mixed exhaust gas stream and is supplied to the preheating zone.

13 Claims, 2 Drawing Figures

PROCESS AND APPARATUS FOR FIRING PELLETS

Figure 1:
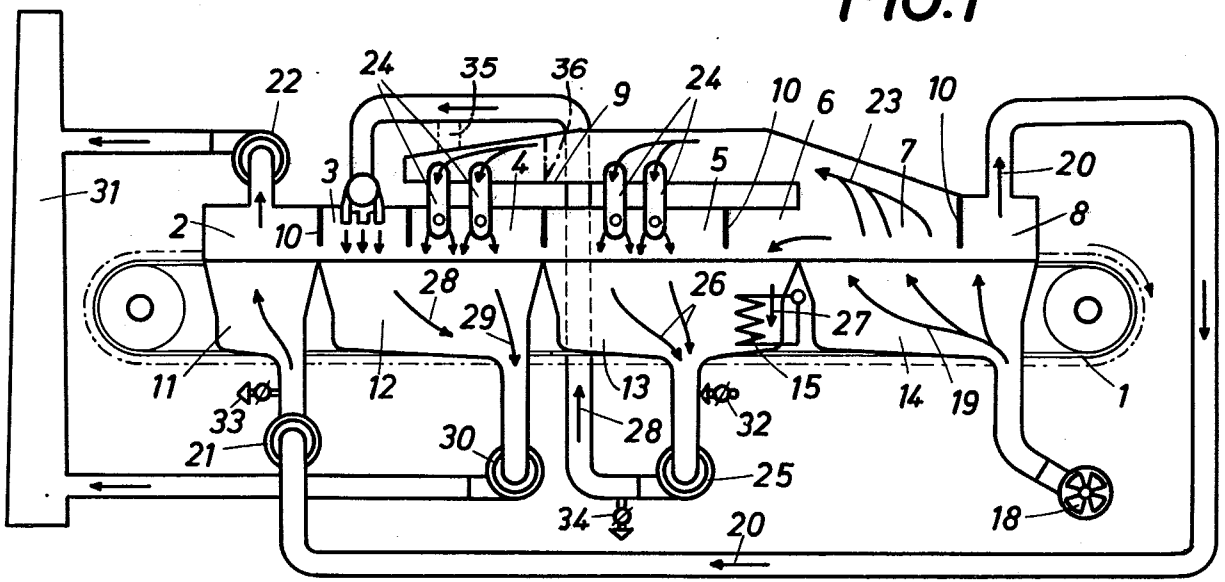

This invention relates to a process of firing pellets on a traveling grate, on which the pellets are dried in first and second drying zones, heated in a preheating zone, fired in first and second firing zones, and cooled in first and second cooling zones, wherein cooling air is blown through the charge in the two cooling zones, exhaust air from the first cooling zone is supplied to the first and second firing zones, exhaust air from the second cooling zone is supplied to one of the drying zones, and exhaust gas from the first and second firing zones is fed to the other drying zone.

Green pellets consisting of ore and additives are charged onto a traveling grate to form a bed having a certain thickness and by the grate are carried through a kiln, in which they are dried, heated, fired and cooled in the four main stages of the process. To optimize the firing process from the aspect of heat economy, the kiln is usually subdivided into a plurality of zones so that the process gases can be separately exhausted from the several zones and be re-used in other zones. For instance, U.S. Pat. No. 3,172,754 describes a process in which the pellets travel through seven zones, which consist of first and second drying zones, a preheating zone, first and second firing zones, and first and second cooling zones and in which exhaust air from the first cooling zone is re-used in the preheating zone and in the first and second firing zones and exhaust air from the second cooling zone is re-used in the second drying zone. The hotter portion of the exhaust gases from the first firing zone and the hot exhaust gases from the second firing zone are supplied directly to the first drying zone. Because the pellets should be dried slowly at a temperature which is not excessive, fresh air which has not been preheated must be admixed to the recycled gas. This is required also in order to cool the process gases in other portions of the gas- and air-handling system. As a result of this temperature control effected by a supply of fresh air, the rate at which exhaust gas must be circulated in the firing process rises strongly so that powerful blowers are required, which involve high capital and operating expenses. Another disadvantage of the known process resides in the fact that part of the process gas which includes added fresh air cannot be utilized in the process and must be discharged into the atmosphere at a relatively high temperature so that heat is lost at a correspoonding rate in the overall process.

It is an object of the invention to eliminate these disadvantages and so to improve a process of the kind described hereinbefore that the supply rate of fresh air can be reduced and the heat content of the process gases can be utilized in a higher degree.

This object is accomplished according to the invention by cooling the exhaust gases from the second firing zone in a waste heat boiler and subsequently feeding the cooled exhaust gases together with the exhaust gases from the first firing zone to one of the drying zones. In the waste heat boiler, the hot exhaust gases from the second firing zone can be cooled to such a degree that the mixed gases consisting of the exhaust gas leaving the waste heat boiler and the exhaust gas from the first firing zone has just the temperature which is required for the drying of the pellets. As a result, a temperature control by an addition of fresh air is not required at all or is required only to a very small extent so that the rate of gas flow remains small and less powerful blowers may be used. The waste heat boiler permits also of an improved utilization of the process heat because the steam produced in the waste heat boiler can be used, e.g., to preheat heavy oil and/or to atomize oil fired in the burners as well as for a production of electric power and for other purposes.

Because only exhaust gases at a high temperature can be economically utilized in the waste heat boiler, the latter is supplied in most cases only with the exhaust gases from the second firing zone, which are the hottest gases. On the other hand, within the scope of the invention, sufficiently hot exhaust gases from the first firing zone may be fed through the waste heat boiler in addition to the exhaust gases from the second firing zone.

According to a preferred further feature of the invention, exhaust air from the second cooling zone is supplied to the first drying zone and the mixture consisting of the exhaust gases from the second firing zone which have passed through the waste heat boiler, and the exhaust gases from the first firing zone is supplied to the second drying zone. The air from the second cooling zone has been only slightly heated and is used directly in the first drying zone and from the latter is blown into the atmosphere. The air from the first cooling zone has been more highly heated and is supplied to the preheating zone and the first and second firing zones. The surplus heat of the hot exhaust gases from the second firing zone and the hottest part of the exhaust gases from the first firing zone is extracted in the waste heat boiler so that the mixed gas consisting of the exhaust gases which have not passed through the waste heat boiler and the exhaust gases which have passed through the waste heat boiler has the temperature which is required in the second drying zone. The supply of these mixed gases to the second drying zone and the supply of the exhaust air from the second cooling zone to the first drying zone involve the smallest temperature correction of these process gases so that the process is optimized from the aspect of heat economy.

Conventional apparatus for firing pellets on a traveling grate comprise groups of wind boxes, which are disposed under the traveling grate, and manifolds which communicate with the wind boxes of respective groups. According to a further preferred feature of the invention, the wind boxes communicating with the second firing zone and possibly with the hottest portion of the first firing zone, and the manifolds connected to the wind boxes incorporate the heat exchange elements of the waste heat boiler. These heat exchange elements are preferably disposed within or in front of the lining of the wind boxes and manifolds. In this way, the waste heat boiler can be directly integrated in the existing kiln and, above all, the protection of the wind boxes and manifolds against a premature thermal destruction is improved because the wind boxes and manifolds and the refractory lining thereof are cooled by the heat exchange elements and are thus subjected to lower thermal stresses than before.

Figure 2:
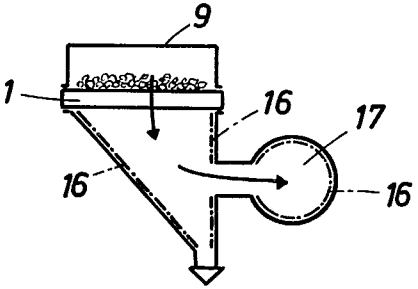

Apparatus for carrying out the process according to the invention is strictly diagrammatically shown on the drawing, in which FIG. 1 shows the basic structure of a firing kiln and FIG. 2 is a transverse sectional view showing the traveling grate in the second firing zone.

A Dwight-Lloyd machine comprises a traveling grate 1 for carrying a bed of pellets through the seven treating zones of the firing kiln, specifically through first and second drying zones 2 and 3, preheating zone 4, first and second firing zones 5 and 6, and first and second cooling zones 7 and 8. These treating zones are defined by partition walls 10 which divide the space under kiln hood 9 extending over the traveling grate 1. Wind boxes arranged in four groups 11, 12, 13, 14 are disposed under the grate 1. The wind boxes of group 11 are associated with the first drying zone 2, those of group 12 with the second drying and preheating zones 3, 4, those of group 13 with the first and second firing zones 5, 6, and those of group 14 with the first and second cooling zones 7, 8. The kiln hood 9 and the wind boxes of groups 11, 12, 13, 14 are sealed at the traveling grate 1 so that the several process steps can be controlled by the adjustment of defined pressures over and under the traveling grate and the pellet charge thereon. To ensure a utilization of the heat content of the hottest exhaust gases and to control the temperature thereof, those wind boxes of group 13 which communicate with the second firing zone contain a waste heat boiler 15. As has been indicated in FIG. 2, the heat exchange elements 16 of the waste heat boiler 15 extend along the walls of the wind boxes of group 13 and of a manifold 17 connected thereto. These heat exchange elements 16 may be disposed within or in front of the refractory lining and thus cool the parts which are subjected to the highest thermal stresses. A premature thermal destruction is prevented in this way.

Green pellets are usually fired to harden them. As a rule, they contain substances which can exothermically react with oxygen so that the pellets can be ignited, e.g., by suitable burners in the first firing zone, whereby in the presence of oxygen an exothermic reaction is initiated, which will then sustain itself without requiring a further supply of external heat. That exothermic reaction will further increase the temperature of the pellets being fired.

As the pellets are fired, the cooling air blower 18 forces cooling air 19 in the two cooling zones 7, 8 through the traveling grate 1 and the charge thereon from bottom to top, causing the air to absorb heat while cooling the pellets to the desired temperature of about 100° to 120° C. The exhaust air 20 from the second cooling zone 8 is only slightly heated (to 250° to 300° C.). The recuperator blower 21 installed in the hood delivers this air to the first drying zone 2 where it flows through the pellet bed from bottom to top to dry the pellets and to cool them to about 50° to 60° C. This air is subsequently blown into the atmosphere by the exhaust air blower 22. The exhaust air 23 from the first cooling zone 7 is heated to about 800° to 900° C. and is delivered to the preheating zone and the first and second firing zones. In the preheating zone 4 and the first firing zone 5, this air together with the combustion gases from the burners 24 flows from top to bottom through the traveling grate and the charge thereon. In the first firing zone 5, the charge is ignited by the burners 24 associated with said zone 5. In the burnerless second firing zone 6, the exhaust air 23 from the first cooling zone 7 flows from top to bottom through the traveling grate and the charge thereon. A blower 25 directly sucks from the wind boxes of group 13 a mixture of exhaust gases 26 which have been supplied to the wind boxes of group 13 from the first firing zone and not passed through the waste heat boiler 15, and of exhaust gases 27 which have been supplied to the wind boxes of group 13 from the second firing zone and passed through the waste heat boiler 15. The blower 25 forces said mixture of exhaust gases into the second drying zone 3. Because the exhaust gases 27 from the second firing zone and the exhaust gases from the final region of the first firing zone are at a very high temperature of about 550° to 650° C., their heat content is utilized in the waste heat boiler, in which surplus heat is recovered and the temperature of said exhaust gases 27 is sufficiently lowered so that these exhaust gases can be mixed with the exhaust gases 26 from the first firing zone which have not been passed through the waste heat boiler and are at a temperature of about 350° to 550° C. The resulting mixed gases have a temperature of about 350° to 550°, which is at least as high as the lower temperature limit of 320° C. for the drying of the pellets. The mixed gases 28 supplied to the second drying zone 3 are forced through the charge on the traveling grate from top to bottom and enter the wind boxes of group 12 and by the blower 30 are subsequently delivered to the chimney 31 together with the exhaust gases 29 which come from the preheating zone and are at a temperature of only 100° to 350° C.

Owing to the provision of the waste heat boiler 15, the hot exhaust gases which are taken from the first and second firing zones can be used to dry the pellets without requiring a temperature control by an admixing of cold air or with only a slight temperature control by such admixing. As a result, the expenditure for the blowers can be minimized. Any additional pressure and temperature control of the process gases which may be provided may be effected by inlet, outlet and by-pass control valves 32, 33, and 34, respectively. As is indicated in FIG. 1 by the branch conduit 35 and the partition 36 shown in phantom, the preheating zone 4 could be supplied with mixed gases 28 from the first and second firing zones rather than with exhaust air 23 from the first cooling zone 7.

What is claimed is:

1. In a process of firing pellets, which comprises moving a charge of pellets on a traveling grate in succession through first and second drying zones, a preheating zone, first and second firing zones, and first and second cooling zones, in that order, drying said pellets in said first and second drying zones, preheating said pellets in said preheating zone, firing said pellets in said first and second firing zones, and cooling said pellets in said first and second cooling zones, forcing cooling air through said charge in said first and second cooling zones, exhausting a first stream of said cooling air from said first cooling zone and delivering at least a part of said exhausted first stream of cooling air to said first and second firing zones, and exhausting a second stream of said cooling air from said second cooling zone and delivering said second stream of exhausted cooling air to one of said drying zones, the steps of (a) exhausting a first exhaust gas stream from said second firing zone and cooling the first exhaust gas stream in a waste heat boiler, (b) exhausting a second exhaust gas stream from said first firing zone and mixing the second exhaust gas stream with said first exhaust gas stream which has been cooled in said waste heat boiler whereby a mixed exhaust gas stream is formed, and (c) delivering at least a part of said mixed exhaust gas stream to the other one of said drying zones.

2. A process as set forth in claim 1, comprising the further step of delivering another part of said exhausted first stream of cooling air to said preheating zone, all of said mixed exhaust gas stream being delivered to the other drying zone.

3. A process as set forth in claim 1, comprising the further step of delivering another part of said mixed gas exhaust stream to said preheating zone.

4. A process as set forth in claim 1, wherein the one drying zone is the first drying zone and the other drying zone is the second drying zone.

5. A process as set forth in claim 1, comprising the further steps of cooling a part of the second exhaust gas stream in said waste heat boiler and mixing said cooled part of the second exhaust gas stream with the mixed exhaust gas stream.

6. In an apparatus for firing pellets, comprising a kiln defining first and second drying zones (2, 3), a preheating zone (4), first and second firing zones (5, 6), and first and second cooling zones (7, 8), a traveling grate (1) arranged to carry a charge of said pellets and operable to move said charge through the first and second drying zones, the preheating zone, the first and second firing zones, and the first and second cooling zones, in that order, a first air blower means (18) for forcing cooling air (19) through said charge in said first and second cooling zones, and for delivering at least a part of a first stream (23) of said cooling air to said first and second firing zones after it has passed through said charge, and a second air blower means (21) for exhausting a second stream (20) of said cooling air from said second cooling zone after it has passed through said charge and for delivering the second stream of cooling air to one (2) of said drying zones, the improvement of (a) an exhaust gas blower (25) means for exhausting a first exhaust gas stream (27) from said second firing zone (6) in a first path and for exhausting a second exhaust gas stream (26) from said first firing zone (5) in a second path, the exhaust gas blower means being arranged to mix said first and second exhaust gas streams and to deliver at least a part of the resultant mixed exhaust gas stream (28) to the other one (3) of said drying zones, and (b) a waste heat boiler (15) in the first path for cooling the first exhaust gas stream (27) before it is mixed with the second exhaust gas stream (26).

7. In the apparatus of claim 6, wherein the first air blower means (18) is arranged to deliver another part of the first stream of said cooling air to said preheating zone (4) after it has passed through said charge, the exhaust gas blower means (25) being arranged to deliver all of the mixed exhaust gas stream (28) to said other drying zone (3).

8. In the apparatus of claim 6, further comprising branch conduit means (35) for delivering another part of the mixed exhaust gas stream to said preheating zone (4).

9. In the apparatus of claim 6, wherein the one drying zone is the first drying zone (2) and the other drying zone is the second drying zone (3).

10. In the apparatus of claim 6, further comprising wind box means (13) disposed below said traveling grate (1) in the first path and a manifold for exhausting the first exhaust gas stream (27) from the wind box means and defining said first path, and the waste heat boiler comprises heat exchange elements (16) disposed in said wind box means and in said manifold.

11. In the apparatus of claim 10, said heat exchange elements being disposed along the walls of the wind box means and manifold.

12. In the apparatus of claim 6, further comprising igniting means (24) in said first firing zone (5) for igniting said charge of pellets.

13. In the apparatus of claim 12, wherein the igniting means comprises burners (24) operable to blow hot combustion gases into said charge in said first firing zone, and further comprising additional burners (24) operable to blow hot combustion gases into said charge in the preheating zone (4).

* * * * *